US009901919B2

(12) United States Patent
Heinonen

(10) Patent No.: US 9,901,919 B2
(45) Date of Patent: Feb. 27, 2018

(54) PIPETTE WITH PISTON ROTATION LOCK

(71) Applicant: Thermo Fisher Scientific Oy, Vantaa (FI)

(72) Inventor: Mauno Heinonen, Vantaa (FI)

(73) Assignee: Thermo Fisher Scientific Oy, Vantaa (FI)

( * ) Notice: Subject to any disclaimer, the term of this patent is extended or adjusted under 35 U.S.C. 154(b) by 262 days.

(21) Appl. No.: 14/352,499

(22) PCT Filed: Oct. 18, 2012

(86) PCT No.: PCT/FI2012/051003

§ 371 (c)(1),
(2) Date: Apr. 17, 2014

(87) PCT Pub. No.: WO2013/057376

PCT Pub. Date: Apr. 25, 2013

(65) Prior Publication Data

US 2014/0242719 A1 Aug. 28, 2014

(30) Foreign Application Priority Data

Oct. 20, 2011 (FI) ..... 20116037

(51) Int. Cl.
*B01L 3/00* (2006.01)
*B01L 3/02* (2006.01)

(52) U.S. Cl.
CPC ..... *B01L 3/0224* (2013.01); *B01L 3/0279* (2013.01); *B01L 2300/026* (2013.01); *B01L 2400/0478* (2013.01); *Y10T 436/2575* (2015.01)

(58) Field of Classification Search
CPC ..... B01L 3/0224
USPC ..... 436/180
See application file for complete search history.

(56) References Cited

U.S. PATENT DOCUMENTS 3,827,305 A * 8/1974 Gilson ..... B01L 3/0224 222/43
4,909,991 A 3/1990 Oshikubo
5,413,006 A 5/1995 D'Autry
5,435,197 A 7/1995 Telimaa et al.
(Continued)

FOREIGN PATENT DOCUMENTS

GB 2 021 972 A 12/1979
JP 7-16614 B2 3/1995
(Continued)

OTHER PUBLICATIONS

Japanese Patent Office, Nichiryo Co. Ltd., English Machine Translation, JP 7-16614 B2, dated Mar. 1, 1995, translated Jun. 19, 2012 (17 pages).
(Continued)

*Primary Examiner* — Christine T Mui
*Assistant Examiner* — Emily R. Berkeley
(74) *Attorney, Agent, or Firm* — Wood Herron & Evans LLP

(57) ABSTRACT

The present invention concerns a pipette comprising a mechanism with which the stroke length of a piston can be changed by rotating the piston rod. The pipette comprises a locking mechanism which prevents the rotation of the piston rod when the piston has been pushed a certain distance downwards from its upper position, but does not prevent the rotation when the piston is in its upper position.

4 Claims, 2 Drawing Sheets

(56) References Cited

U.S. PATENT DOCUMENTS

| | | | |
|---|---|---|---|
| 5,650,124 | A | 7/1997 | Gilson |
| 2004/0035228 | A1 | 2/2004 | Viot |
| 2010/0266453 | A1 | 10/2010 | Rylski et al. |

FOREIGN PATENT DOCUMENTS

| | | | |
|---|---|---|---|
| WO | 84/00119 | A1 | 1/1984 |
| WO | 91/16976 | A1 | 11/1991 |
| WO | 97/33148 | A1 | 9/1997 |
| WO | 2005/050554 | A1 | 6/2005 |
| WO | 2009/118456 | A1 | 10/2009 |

OTHER PUBLICATIONS

European Patent Office, International Search Report and Written Opinion of the International Searching Authority, International Application No. PCT/FI2012/051003, dated Jan. 30, 2013 (10 pages).

* cited by examiner

PIPETTE WITH PISTON ROTATION LOCK

CROSS-REFERENCE TO RELATED APPLICATIONS

This application is a submission under 35 U.S.C. § 371 of International Application No. PCT/FI2012/051003, filed Oct. 18, 2012, which claims priority to Finnish Application No. 20116037, filed Oct. 20, 2011, the disclosures of which are hereby expressly incorporated by reference herein in their entireties.

FIELD OF THE INVENTION

The present invention relates to liquid dispensing and concerns a pipette, in which the dosage volume is set by rotating the piston rod and which comprises a locking device with which accidental change of set volume is prevented.

BACKGROUND OF THE INVENTION

Piston pipettes, which comprise a piston rod extending above the handle, are used for liquid dispensing, for example, in laboratories. The piston can thus be moved by the rod. Also, such pipettes are used in which the length of the intake movement of the piston can be set by rotating the rod. Such a pipette comprises also a volume display, typically based on digit rings, on which the set volume is displayed. One problem of these kinds of pipettes is that the rod may be accidentally rotated during pipetting, whereby also the set volume accidentally changes. In document WO 84/00119, a pipette is described in which for preventing accidental rotation there is a ring-like spring above the uppermost digit ring, the spring comprising at its lower surface protrusions and, corresponding to these, hollows on the upper surface of the ring. The rod can be rotated stepwise against the force of the spring.

The pipette according to document U.S. Pat. No. 4,909,991 comprises around the piston rod a flange non-rotatable with the rod. The body comprises above the flange a threaded sleeve, the upper end of which extends above the body. By rotating the sleeve, its lower end can be pressed tightly against the flange, whereby friction force prevents the accidental rotation of the rod.

The pipette according to document WO 91/16976 comprises a sleeve rotating with the piston rod and having longitudinal grooves on its outer surface. In the body there is a locking device comprising a spring and at its end a claw settling against a groove. The rod can be stepwise rotated against the force of the spring. The locking device can be, however, lifted up above the grooves, whereby the rod is freely rotatable. For this the locking device comprises an operation peg extending outside the body.

SUMMARY OF THE INVENTION

A pipette according to the present invention comprises a locking mechanism which prevents the rotation of the piston rod when the piston has been pushed a certain distance downwards from its upper position, but does not prevent the rotation when the piston is in its upper position. Thus the change of volume setting is prevented during liquid dispensing. In this way no additional operations are needed in order to prevent a setting change, but the mechanism functions automatically when the piston is pushed downwards. A sufficient movement distance for starting the mechanism in action may be, e.g., 0.5-3 mm, preferably 1-2 mm.

The locking mechanism may comprise a locking pin which presses against a part rotating with the rod. This rotating part may be, e.g., a part of a digit ring display, such as the step spring of a digit ring which stops the digit rings so that the digits of the rings match to each other.

The locking mechanism may comprise a locking spring which, when in locking position, presses a locking pin.

The mechanism may prevent the rotation with the help of friction. However, it is also possible to arrange a mechanism in which the rotation is prevented by form locking.

DESCRIPTION OF THE DRAWINGS

The enclosed drawings are a part of the written description of the present invention, and they relate to the detailed description of some embodiments of the present invention presented next. In the drawings.

DETAILED DESCRIPTION OF THE INVENTION

Figure 1:
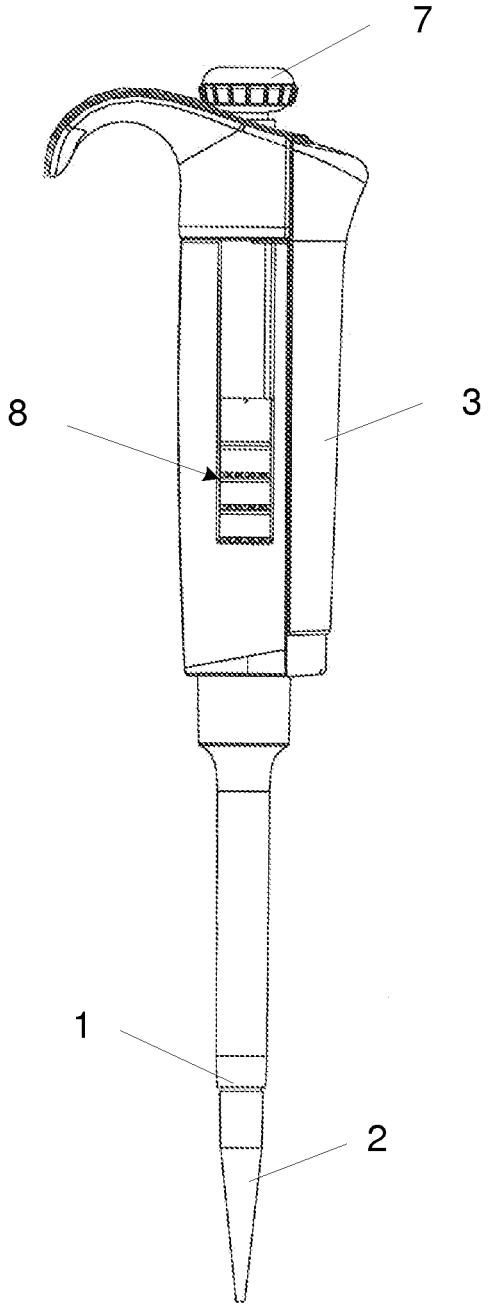
FIG. 1 shows a pipette in accordance with the present invention from front.
Figure 2:
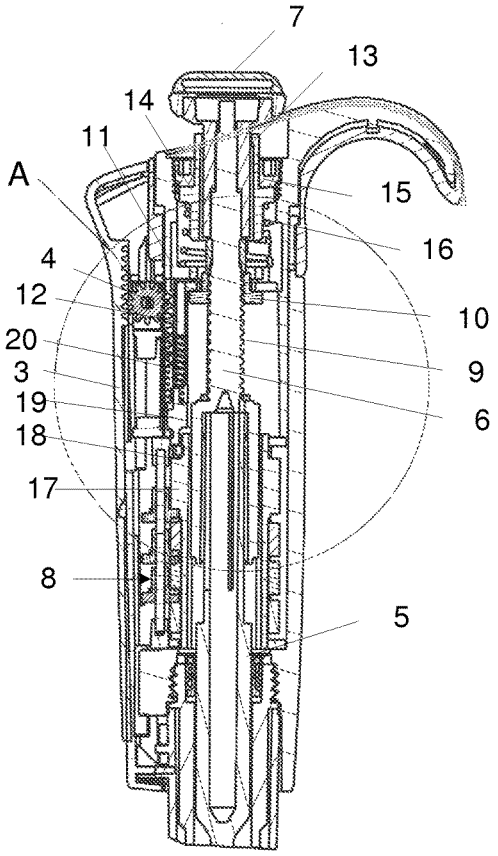
FIG. 2 shows the upper part of the pipette from behind as an enlarged cut figure.
Figure 3:
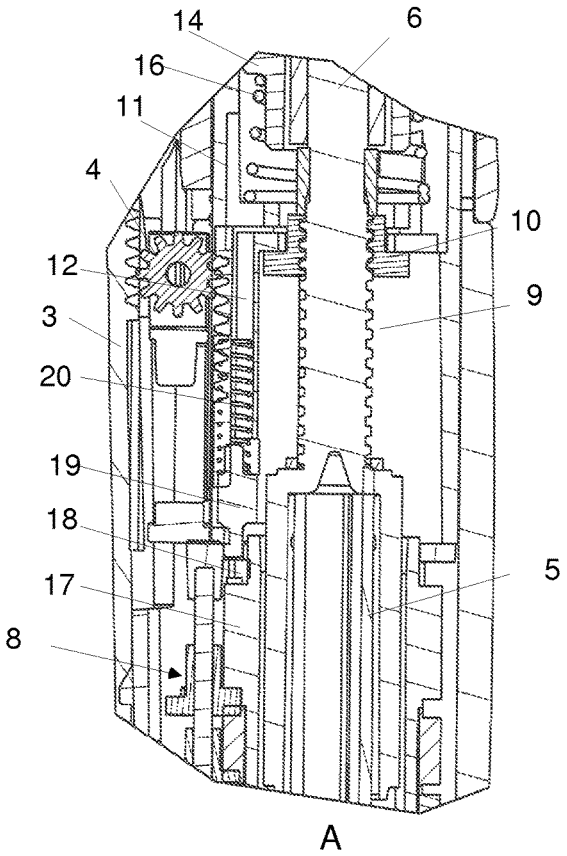
FIG. 3 shows the partial enlargement A of FIG. 2.
Figure 4:
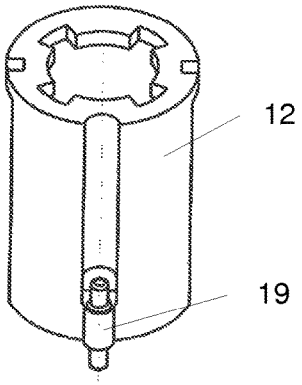
FIG. 4 shows the locking sleeve of the pipette obliquely from above, and FIG. 5 the locking sleeve obliquely from above in another angle.
Figure 5:
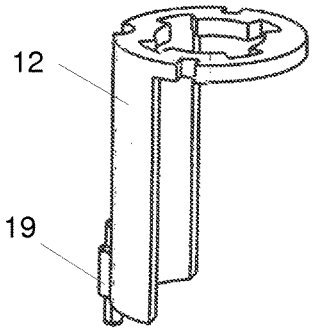

A pipette in accordance with the figures comprises at its lower end a tip part 1, at the lower end of which there is a pipette tip or tip 2 for liquid. On the tip part there is a sliding tip removal sleeve, and on the side of body there is a tip remover push button 3 as an extension of the sleeve, which button has been forced to move along the body by means of a wheel 4 in order to decrease the operation force (see, e.g., U.S. Pat. No. 5,435,197). In the upper end of the body on the opposite side from the button there is a finger support. In the body there is a cylinder and as an extension thereof an aspirating channel going through the tip part. In the cylinder there is a moveable piston 5 having an extending piston rod 6, in the upper end of which there is a piston knob 7 above the upper end of the body. The piston is moved by pushing the knob. The desired dispensing volume is set by rotating the rod by the knob. The set volume is displayed in the opening on the side of the body by a digit ring display 8 having four digit rings.

In the tip part there is arranged around the piston 5 a primary spring (not in the drawings), which presses the piston against the piston rod 6. The piston rod comprises at its lower end a hollow, in which the upper end of the piston settles. The piston rod comprises an adjustment thread 9, on which an adjustment nut 10 has been fitted so that its rotation in relation to the body has been prevented. In the body there is a fixed limiter 11. A sliding locking sleeve 12 has been fitted around the piston rod. The primary spring presses the adjustment nut against a flange at the upper end of the locking sleeve, whereby the adjustment nut and the locking sleeve settle against the fixed limiter. The adjustment nut and the fixed limiter thus define the upper limit of the piston stroke. Around the upper part of the rod there is placed a limiter piece 13 having at its upper end a broader limiter flange. Around the limiter piece there is fitted a sliding sleeve-like secondary support 14 having a flange on its outer surface. Above the secondary support there is fitted in a boring in the handle a calibrating screw 15. Between the fixed limiter and the flange in the secondary support there is fitted a secondary spring 16, which is stronger than the primary spring, the secondary spring thus pressing the secondary support against the calibration screw.

When the piston rod is pushed, it moves downwards against the force of the primary spring until the flange of the limiter piece 13 meets the upper end of the secondary support 14. When the pipette tip 2 is now brought into the liquid to be aspirated and the piston is allowed to return to its upper position, a liquid volume corresponding to the stroke length is received into the tip. By rotating the calibration screw 15, the lower limit of the aspiration movement may be slightly changed and thus the volume calibrated precisely to correspond to the nominal volume. When removing the liquid, after the limit piece meets the secondary support, the rod is pushed still more, whereby also the secondary spring 16 yields in and the piston moves further lower. Thus the liquid is removed as completely as possible.

The volume display 8 is based on digit rings. On the piston rod 6 there is fitted sliding, but non-rotating, the uppermost digit ring 17. It rotates by means of the first step wheel the second digit ring, which rotates the third, and the fourth. The uppermost digit ring comprises a projection, on the upper surface of which a stepping spring 18 is attached. It stops the digit ring on its place so that the digit set on the ring is seen in the middle of the body opening. With a small force the digit ring can be rotated, however. A snapping sound is formed from the step movement. Corresponding volume adjustments have been described, e.g., in documents EP 112 887, and WO 2005/050554.

On the outer surface of the locking sleeve 12, there is a longitudinal groove, on the lower end of which there is attached a locking pin 19. A locking spring 20 presses the locking pin downwards in the groove. The upper end of the locking spring is against the fixed limiter 11. When the piston is pushed downwards, the locking spring pushes the locking sleeve downwards, whereby the locking pin presses against the stepping spring 18 preventing the uppermost digit ring from rotating. Thus the volume setting is not accidentally changed when the liquid is dispensed. The move distance of the locking pin may be, e.g., 1-2 mm. Using a sufficiently great force, the knob can, however, be rotated also in the locking position. Thus, for instance, accidental breakage of the construction may be prevented. Thereby, the locking force may also be changed by replacing the locking spring with a stronger or weaker one. The locking may be made also completely non-sliding by arranging for the locking pin locking holes, into which the lower end of the pin protrudes.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A pipette, comprising:

a body with an upper end and a lower end;

a cylinder disposed in the body and having an upper end and an open lower end;

a piston disposed in the cylinder and comprising a piston rod on the upper end of the cylinder, whereby the piston has an upper position from which it can be pushed downwards by the rod;

an adjustment mechanism with which a stroke length of the piston can be changed by rotating the piston rod; and a locking mechanism which is configured to automatically prevent rotation of the piston rod when the piston has been pushed a certain distance downwards from its upper position, but does not prevent the rotation when the piston is in its upper position, wherein the locking mechanism comprises a locking spring which in a locking position presses a locking pin.

2. The pipette according to claim 1, wherein the locking mechanism comprises a locking pin which, when the locking mechanism prevents the rotation of the piston rod, presses against a part rotating with the piston rod.

3. The pipette according to claim 2, comprising a digit ring display of volume and wherein the part rotating with the piston rod is a plurality of digit rings or a step spring connected with at least one of the plurality of digit rings, which spring stops the plurality of digit rings stepwise so that digits of the plurality of digit rings align with each other.

4. A method for preventing the rotation of a piston in a pipette comprising a body with an upper end and a lower end, a cylinder disposed within the body and having an upper end and an open lower end, a piston disposed in the cylinder and comprising a piston rod on the upper end of the cylinder, whereby the piston has an upper position from which it can be pushed downwards by the rod, and an adjustment mechanism with which a stroke length of the piston can be changed by rotating the piston rod, the method comprising:

automatically preventing the piston rod from rotating by a locking mechanism when the piston has been pushed a certain distance downwards from its upper position; and not preventing the piston rod from rotating when the piston is in its upper position, wherein the rotation is prevented by the locking mechanism by using a locking spring which in a locking position presses a locking pin.

* * * * *